US005193376A

United States Patent [19]

Weitl

[11] Patent Number: 5,193,376

[45] Date of Patent: Mar. 16, 1993

[54] MACHINE AND METHOD FOR REPAIRING DAMAGED GRAIN AERATION PIPES

[76] Inventor: Gary E. Weitl, Rte. 1, Box 122, Templeton, Iowa 51463

[21] Appl. No.: 775,915

[22] Filed: Oct. 15, 1991

[51] Int. Cl.[5] ..... B21D 3/02

[52] U.S. Cl. ..... 72/110; 72/106

[58] Field of Search ..... 72/101, 106, 110, 111, 72/105, 107

[56] References Cited

U.S. PATENT DOCUMENTS

| | | | |
|---|---|---|---|
| 455,186 | 6/1891 | Elmore . | |
| 1,045,161 | 11/1912 | Machlet | 72/107 |
| 1,209,071 | 12/1916 | Taylor | 72/106 |
| 1,930,562 | 10/1933 | Krueger . | |
| 2,550,842 | 5/1941 | McClure . | |
| 2,649,129 | 8/1953 | Schlank | 72/101 |
| 3,464,253 | 9/1969 | Beyer . | |

FOREIGN PATENT DOCUMENTS

| | | | |
|---|---|---|---|
| 95835 | 4/1989 | Japan | 72/106 |

*Primary Examiner*—Lowell A. Larson

*Attorney, Agent, or Firm*—Zarley, McKee, Thomte, Voorhees & Sease

[57] ABSTRACT

The method of straightening deformed hollow light-weight metal pipe by threading the deformed pipe over the uppermost of three rolls where the upper roll is positioned in overlapping condition with two horizontal lower rolls. The rolls are then moved so that they lightly engage the pipe. The lower rolls are rotated in one direction, and the upper roll in an opposite direction, whereupon deformations in the pipe are moved to the arc of the periphery of the tube defined generally by the two points of close positioning of the upper roll with each of the lower rolls. The machine for carrying out the method has a frame with the three horizontal rolls supported thereon. Hydraulic motors power each of the rolls. A movable end frame normally supports one end of the upper roll, but can be pivoted out of the way to permit the deformed pipe to be inserted on the upper roll. Circular or spiral rings are on the lower and/or upper rolls to accommodate corrugations in the deformed pipe.

10 Claims, 4 Drawing Sheets

MACHINE AND METHOD FOR REPAIRING DAMAGED GRAIN AERATION PIPES

BACKGROUND OF THE INVENTION

Aeration tubes are commonly used for conditioning grain. These tubes are usually comprised of lightweight metal, are cylindrical in shape, contain a plurality of perforations, and typically have a plurality of ribs formed in the tube walls. These ribs sometimes are formed in a helix or spiral, but are sometimes only a series of parallel spaced circular indentations.

These tubes exist in a harsh environment in that they are moved, stored, assembled and disassembled into and from end to end connection. As a result, these tubes are often dented, bent, twisted, or otherwise deformed.

It is therefore a principal object of this invention to provide a device and method for straightening aeration tubes which will correct a wide variety of deformations.

A further object of this invention is to provide a device and method for straightening aeration tubes which can straighten deformations in tubes regardless of the pattern of any ribs therein.

A still further object of this invention is to provide a device and method for straightening aeration tubes which can be used to correct quickly the deformations in the tubes.

A still further object of this invention is to provide a device and method for straightening aeration tubes which is portable.

A still further object of this invention is to provide a device and method for straightening aeration tubes which is easily controlled, and operated by one person.

These and other objects will be apparent to those skilled in the art.

BRIEF SUMMARY OF THE INVENTION

The method of straightening deformed hollow lightweight metal pipe involves threading the deformed pipe over the uppermost of three rolls where the upper roll is positioned in overlapping condition with two horizontal lower rolls. The rolls are then moved so that they forceably engage the pipe. The lower rolls are rotated in one direction, and the upper roll in an opposite direction, whereupon deformations in the pipe are moved to the arc of the periphery of the tube defined generally by the two points of close positioning of the upper roll with each of the lower rolls. The machine for carrying out the method has a frame with the three horizontal rolls supported thereon. Hydraulic motors power each of the rolls. A movable end frame normally supports one end of the upper roll, but can be pivoted out of the way to permit the deformed pipe to be inserted on the upper roll. Circular or spiral rings are on the lower and/or upper rolls to accommodate corrugations in the deformed pipe.

DESCRIPTION OF THE PREFERRED EMBODIMENT

Figure 4:
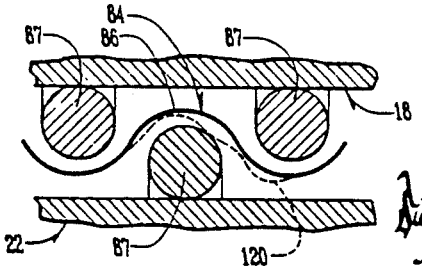
FIG. 4 is an enlarged scale sectional view showing how the upper and lower rolls cooperate to correct a deformation in a pipe.

The numeral 10 designates an elongated frame which has opposite end frames 12 and 14. Each end frame has vertical legs 16 and upper cross beams 12A and 14A respectively. Frame 10 is normally mounted on a flat deck of a truck bed or trailer so that the device of the invention can be moved to the location where the damaged pipes are located.

The numerals 18, 20 and 22 designate the upper, and two lower rolls, respectively, used in this invention. The lower rolls 20 and 22 have center shafts 24 which are rotatably mounted in bearings 26 which in turn are adjustably secured to the upper surfaces of beams 12A and 14A by bolts 28 (FIG. 8) which are mounted in pairs of a plurality of apertures (not shown) in the beams. This permits the lower rolls to be adjustably spaced with respect to each other if needed.

Figure 6:
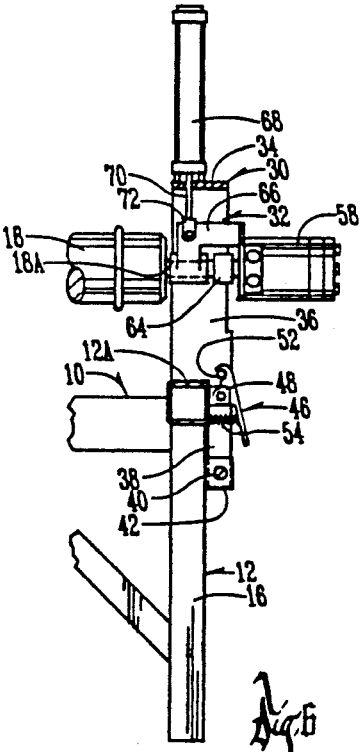
FIG. 6 is an enlarged scale sectional view taken on line 6—6 of FIG. 1.
Figure 8:
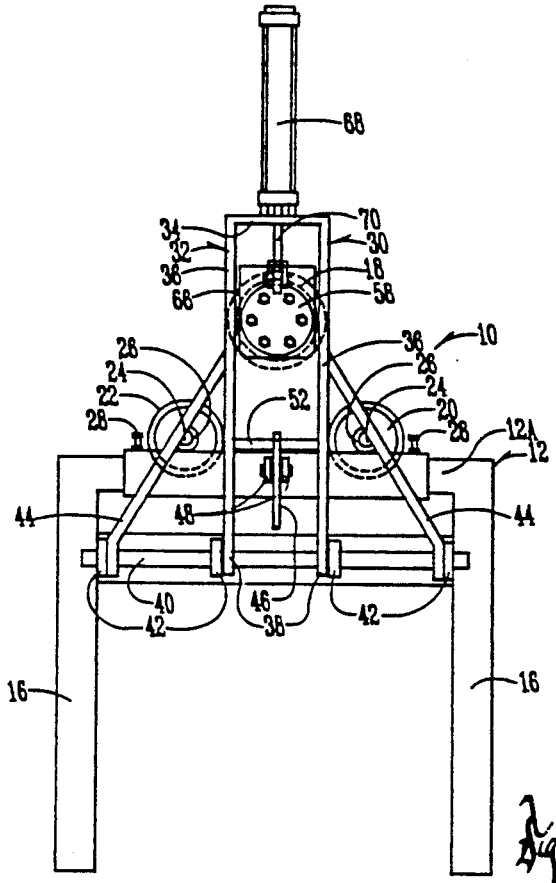
FIG. 8 is an enlarged scale end elevational view taken on line 8—8 of FIG. 2.

With particular reference to FIGS. 6 and 8, a movable end frame 30 is comprised of a vertical column 32 which has a top 34, spaced sides 36, and eccentrically mounted legs 38. Legs 38 are pivotally supported at their lower ends by horizontal bar 40 which extends through suitable apertures in legs 38, and which is supported by its ends in brackets 42 welded to legs 16 of end frame 12. Diagonal braces 44 are pivotally secured at their lower ends to bar 40, and extend upwardly and inwardly where they are welded by their upper ends to the sides 36 of column 32. (FIG. 8).

Figure 7:
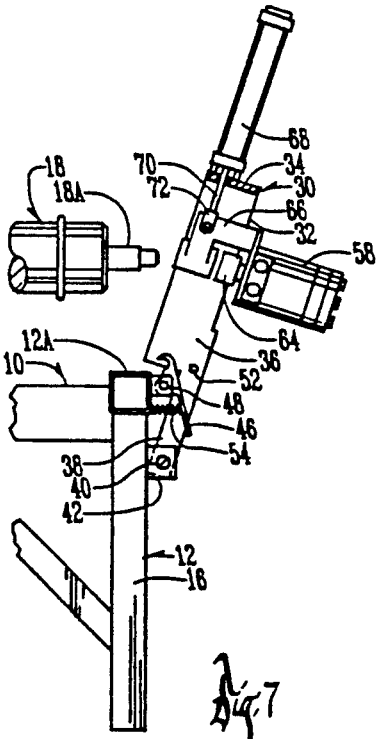
FIG. 7 is a view similar to that of FIG. 6 but shows the secondary end frame pivoted away from the powered end of the upper roll.

A latch bar 46 is pivotally mounted between bars 48 which are secured to beam 12A. Bar 46 has an upper end adapted to engage and lock on rod 52 which extends between legs 38. (FIGS. 6 and 7). Spring and rod assembly 54 normally keep latch bar 46 locked on bar 52.

Figure 11:
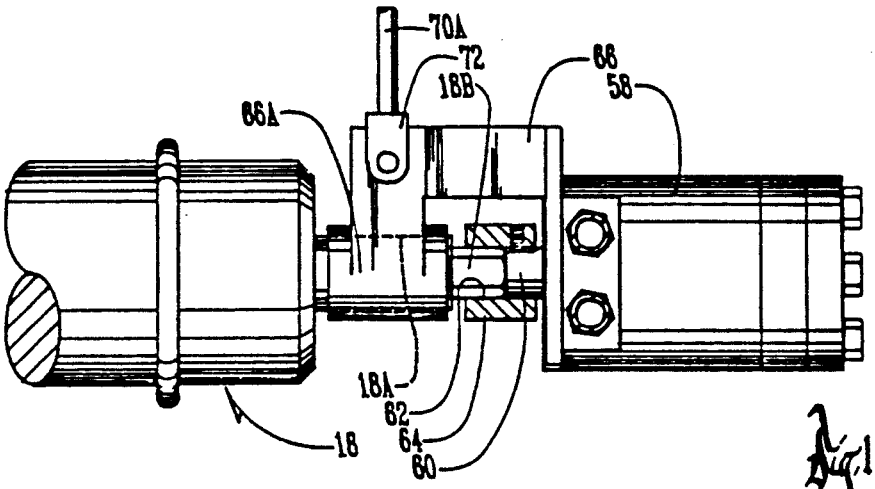
FIG. 11 is an enlarged scale sectional view showing the coupling between the motor and the powered end of the upper roll.

A hydraulic motor 58 has a horizontal power shaft 60 to which is detachably secured to a square socket or aperture 62 in coupling 64. (FIG. 11). Coupling 64 is adapted to receive shaft extension 18B on the end of center shaft 18A of upper roll 18 so that when motor 58 and column 32 pivot away from upper roll 18, (FIG. 12) as described hereafter, the coupling 64 remains with motor 58.

A bracket 66 is secured to motor 58 and extends into column 32 to slide within the column sides 36. A bushing 66A is secured to bracket 66 and is aligned with coupling 64. Bushing 66A slidably and rotatably receives center shaft 18A when shaft extension 18B is aperture 62 of coupling 64. A hydraulic cylinder 68 is rigidly secured to the upper end 34 of column 36, and a downwardly extending piston rod 70 slidably extends through end 34 and is pivotally secured to bracket 66 by clevis device 72 (FIG. 6). Thus, the upward or lower movement of piston rod 70 will cause bracket 66, motor 58, and the powered end of upper roll 18 to move correspondingly when the motor 58 is coupled to upper roll 18 as in FIG. 6.

Figure 1:
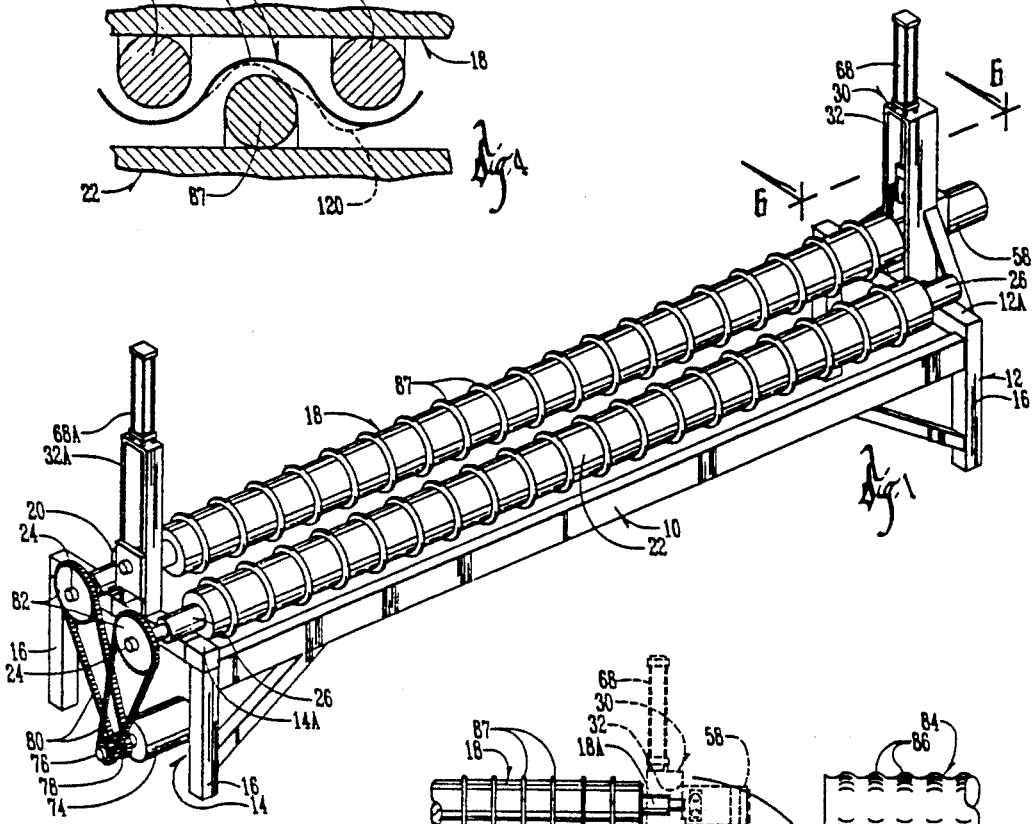
FIG. 1 is a perspective view of the device of this invention.
Figure 12:
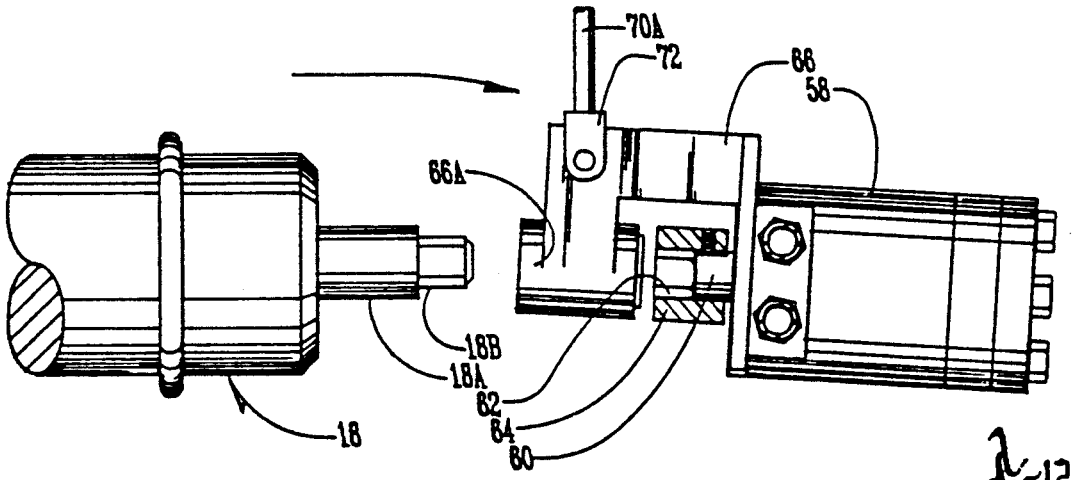
FIG. 12 is a view similar to that of FIG. 11 but shows how the motor and related apparatus can be pivoted away from the powered end of the upper roll.

By releasing latch bar 46, the column 32, motor 58, and cylinder 68 can pivot away from the powered end of upper roll 18 as shown in FIGS. 7 and 12. The upper roll is maintained in its horizontal position in cantilever fashion by the column 32A on end frame 14 (FIG. 1). Column 32A has components corresponding to that of column 32 (e.g. cylinder 68A, etc.) except for the legs 38 of column 32. Column 32A has no legs, and is welded or otherwise rigidly secured to beam 14A.

As seen in FIG. 1, a second hydraulic motor 74 has a horizontal power shaft 76 with a dual sprocket 78 thereon to accommodate chains 80 which are connected to sprockets 82 on the center shafts 24 of lower rolls 20 and 22.

Figure 9:
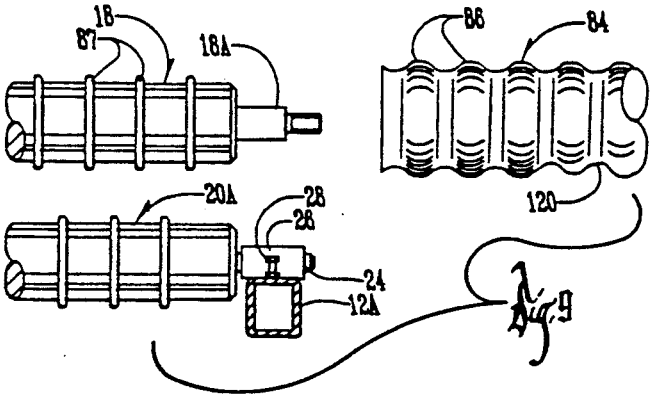
FIG. 9 is a schematic view showing the roll configurations used for deformed pipe which has circular corrugations.
Figure 10:
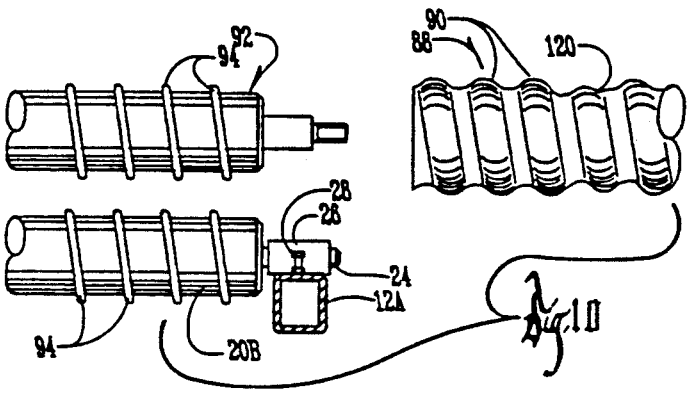
FIG. 10 is a schematic view showing the roll configurations used for deformed pipe which has spirally disposed corrugations.

With reference to FIG. 9, when an aeration pipe 84 having circular corrugations 86 is to be treated, an upper roll 18 is used which has a plurality of circular rings 87 welded in uniformly spaced positions on the outer surface thereof corresponding to the spaces between corrugations 86 in pipe 84. Lower rolls 20A and 22A (not shown) are used in such case with circular rings 87 secured thereto but staggered in position with respect to the rings 87 on roll 18. With reference to FIG. 10, when an aeration pipe 88 having a continuous spiral corrugation 90 is to be treated, an upper roll 92 is used which has a spiral rod 94 welded to its outer surface. The configuration of spiral rod 94 conforms to that of spiral corrugation 90 of pipe 88. In such case, lower roll 20B, and lower roll 22B (not shown) are used, both of which have offset spiral rods or rings 94 on the outer surface thereof. If the damaged pipe has no corrugations but only a spiral seam, the lower rolls preferably will have no spiral rings 94, but will be smooth and rubber coated for friction.

Figure 5:
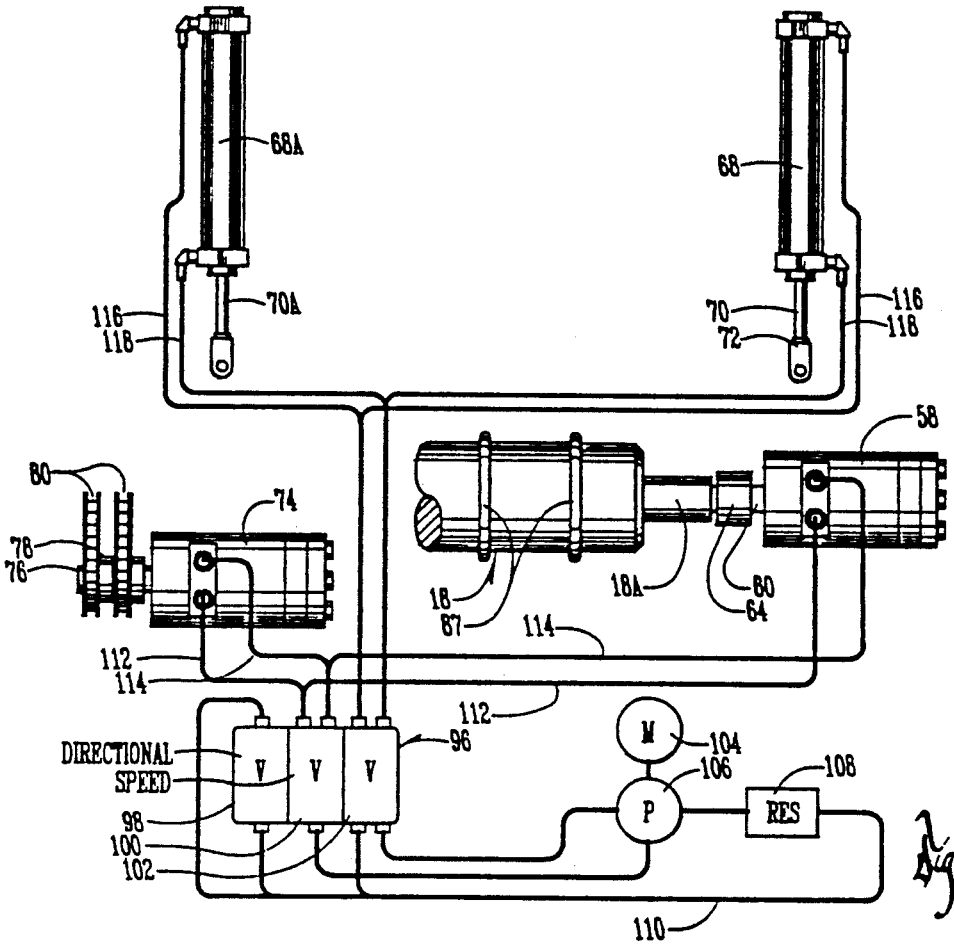
FIG. 5 is a schematic hydraulic circuit showing the controls for the device of FIG. 1.

The hydraulic circuit 96 used with the foregoing structure is shown in FIG. 5. The valves 98, 100 and 102 can be mounted on frame 10 in any convenient manner, as can all other parts of circuit 96. Motor 104 drives pump 106 which is connected to oil reservoir 108. The reservoir 108 is connected to each of the valves 98, 100, 102 and by lines 110. Valve 98 in a first of two positions causes oil in lines 110 to flow in a first direction. In a second position, oil in lines 110 flows in an opposite direction. Valve 100 controls the speed of oil flow in the circuit. Valve 102 is used to raise or lower the piston rods in pistons 68 and 68A to raise or lower the upper roll. Valve 100 has outlet lines 112 which series connect motors 58 and 74. Return lines 114 from the motor return to valve 100. Lines 116 series connect valve 102 to the upper ends of cylinder 68 and 68A, and lines 118 series connect valve 102 to the lower ends of these cylinders.

The deformations in the pipes 84 and 88 are designated by the numeral 120 in FIGS. 4, 9 and 10. The proper rolls can be inserted in the machine as required by the corrugation configuration of the damaged pipe, as explained above.

Figure 3:
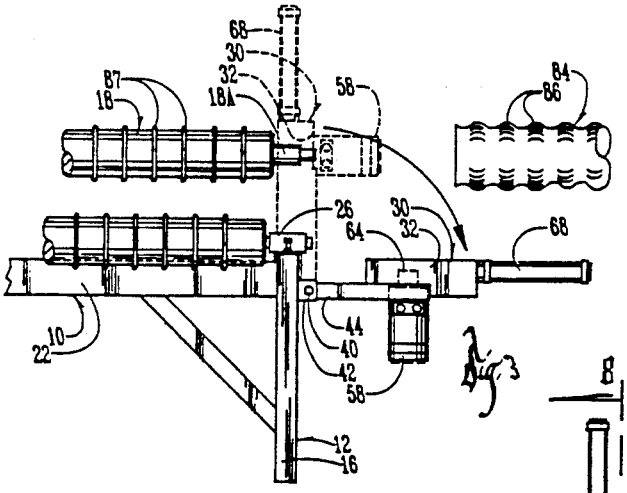
FIG. 3 is partial side view of the right hand end of the device shown in FIG. 1 illustrating how a damaged pipe is inserted onto the upper roll.
Figure 2:
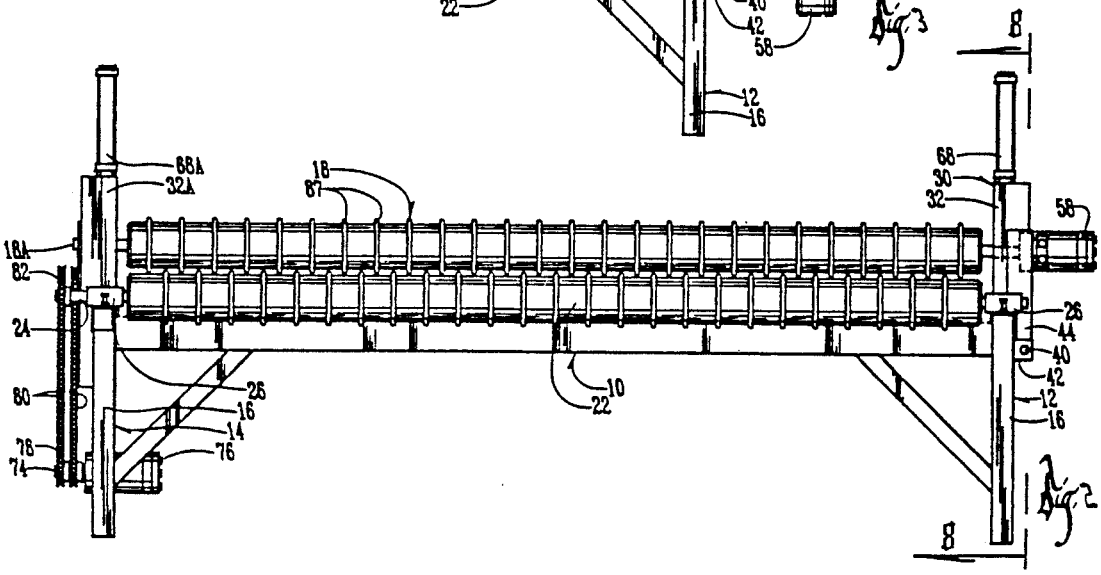
FIG. 2 is a side elevational view of the device of FIG. 1.

Typically, a damaged pipe is first stretched to its accurate length by an apparatus not shown. If tears or cuts appear in the pipe, they are mended by brazing or the like. The damaged pipe is then inserted onto the upper roll 18 in the manner described by first lowering column 32, placing the pipe on roll 18, and then closing column 32 and latching it closed by latching bar 46. All this is done while upper roll 18 is raised from the lower rolls 20 and 22 to provide space therebetween to receive the damaged pipe. (See FIG. 3).

The upper roll 18 is then lowered by valve 102 to cause piston rods 70 and 70A to extend from cylinder 68 and 68A respectively. The upper roll 18 is lowered so that the wall of the damaged pipe is forceably nestled with respect to the rods or rings on the rolls as generally illustrated in FIG. 4.

Valve 98 is then actuated to cause motors 58 and 74 to rotate. The moors and any sprockets and chains associated therewith are coordinated so that the upper and lower rolls rotate in opposite directions, and rotate at the same speed. The rolls rotate at a speed of 2–10 rpms controlled by valve 100—and usually at a speed of about 2 rpms. Normally, the tube is thereupon rotated between the upper and lower rolls from one to three times, but usually only once. If it is necessary to reverse the direction of rotation for some special purpose, valve 98 is merely moved to a second position.

This invention is not limited to the precise hydraulic circuit of FIG. 5. For example, all rolls could be driven from the same end by moving motor 58 to the general location of the motor 74, or by driving all three rolls with the same motor.

The coaction of the upper and lower rolls, as best seen in FIG. 4, move the deformation 120 back to or very close to its original shape. This process takes only a few minutes, and restores an otherwise unusable expensive pipe to normal condition. The restored pipe is then removed from upper roll 18 by reversing the insertion procedure.

It is therefore seen that this invention will accomplish at least all of its stated objectives.

I claim:

1. A method of straightening a hollow lightweight metal cylindrical deformed pipe, comprising, positioning a first power roll having a diameter less than the diameter of said deformed pipe within said deformed pipe substantially along the length thereof, positioning second and third power rolls in laterally close and overlapping aligned horizontal relation with said first power roll to frictionally bind a portion of the periphery of said deformed pipe between said first power roll and said second and third power rolls, and simultaneously applying rotational power to said first, second and third power rolls for rotating said first power roll in one direction and rotating said second and third power rolls in an opposite direction to rotate said deformed pipe and to cause deformation in said deformed pipe to be forced into a corrected cylindrical shape as the periphery of said deformed pipe passes between said first power roll and said second and third power rolls.

2. The method of claim 1 wherein said deformed pipe is comprised of a cylindrical wall having a corrugated surface configuration, and placing ring means on the surface of said first power roll in a complimentary position with respect to said corrugated surface configuration to permit said ring means to exert corrective shaping force on deformations in said deformed pipe.

3. The method of claim 2 wherein second ring means are positioned on said second and third power rolls at offset positions with respect to said ring means on said first power roll.

4. The method of claim 1 wherein said first, second, and third power rolls are rotated at substantially the same speed.

5. A machine for straightening a hollow lightweight metal cylindrical deformed pipe, comprising, a frame, a first power roll on said frame, second and third power rolls on said frame in alignment with and in overlapping condition said first power roll, means on said frame for raising and lowering said first power roll with respect to said second and third power rolls, means on said frame for releasably supporting one end of said first power roll so that said first power roll can be suspended in cantilever fashion to receive a hollow deformed cylindrical pipe on its outer surface, and power means connected to said first, second and third power rolls to simultaneously rotate said first power roll in a first direction and to rotate said second and third power rolls in a second direction.

6. The machine of claim 5 wherein said power means rotates said first, second and third power rolls at substantially the same speed.

7. The machine of claim 5 wherein said first power roll has spaced ring means on the outer surface thereof.

8. The machine of claim 7 wherein said second and third power rolls have second ring means on the outer surfaces thereof, with said second ring means being offset with respect to said ring means on said first power roll.

9. The machine of claim 5 wherein a control means is connected to said power means to control the speed of rotation and the direction of rotation of said first, second and third power rolls.

10. The machine of claim 5 wherein said means for releasably supporting said one end of said first power roll is an end frame pivotally secured to one end of said frame.

* * * * *